US008222580B2

(12) United States Patent
Lee et al.

(10) Patent No.: US 8,222,580 B2
(45) Date of Patent: Jul. 17, 2012

(54) COOKING APPARATUS USING MICROWAVES

(75) Inventors: Won Hui Lee, Kyunggi-do (KR); Hyun Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1295 days.

(21) Appl. No.: 11/979,003

(22) Filed: Oct. 30, 2007

(65) Prior Publication Data

US 2008/0099475 A1 May 1, 2008

(30) Foreign Application Priority Data

Nov. 1, 2006 (KR) ..... 10-2006-0107290

(51) Int. Cl.
*H05B 6/72* (2006.01)

(52) U.S. Cl. ..... 219/748; 219/730; 219/685

(58) Field of Classification Search ..... 219/748, 219/749, 746, 745, 757, 751, 747, 750; 99/357, 99/447

See application file for complete search history.

(56) References Cited

U.S. PATENT DOCUMENTS

| | | | | |
|---|---|---|---|---|
| 4,421,968 | A * | 12/1983 | Osepchuk | 219/749 |
| 4,430,539 | A * | 2/1984 | Suzuki | 219/749 |
| 2005/0184067 | A1 * | 8/2005 | Hu et al. | 219/746 |
| 2007/0158328 | A1 | 7/2007 | Kim et al. | |
| 2007/0246453 | A1 | 10/2007 | Nam et al. | |
| 2007/0251936 | A1 | 11/2007 | Nam et al. | |
| 2007/0257020 | A1 | 11/2007 | Nam et al. | |

OTHER PUBLICATIONS

U.S. Appl. No. 11/939,844 to Lee, filed Nov. 14, 2007.

* cited by examiner

*Primary Examiner* — Quang Van

(74) *Attorney, Agent, or Firm* — Birch, Stewart, Kolasch & Birch, LLP

(57) ABSTRACT

A cooking apparatus which uses microwaves is provided having a microwave supplier which supplies microwaves into the cooking chamber. More particularly, the microwave supplier may be provided proximate an upper side of the cooking chamber; and a microwave radiator may be provided inside of the cooking chamber to re-radiate the microwaves.

26 Claims, 8 Drawing Sheets

COOKING APPARATUS USING MICROWAVES

This application claims the benefit of the Korean Patent Application No. 2006-0107290, filed on Nov. 1, 2006, which is hereby incorporated by reference in its entirety.

BACKGROUND OF THE INVENTION

1. Field of the Invention

The present invention relates to a cooking apparatus which uses microwaves and, more particularly, to a cooking apparatus having improved uniform heating performance.

2. Description of the Conventional Art

Generally, a cooking apparatus utilizing microwaves which are irradiated to a non-conducting substance such as foods (hereinafter, referred to as "contents" or a "cooking object") thereby cooking an inside of the contents evenly in a short time due to the molecular vibrations in the contents (or the cooking object).

The cooking apparatus which uses microwaves includes a microwave oven (MWO) which cooks the contents in the cooking chamber with microwaves, an over the range (OTR), arranged at an upper side of the cooking apparatus, and having a hood function which exhausts smoke and smell (or odor), an electric oven having a heater and a cooking function which uses microwaves.

The conventional cooking apparatus using microwaves, however, has a disadvantage in that the cooking object received in the cooking chamber is heated unevenly (or unequally), as the microwaves are radiated unevenly into the cooking chamber. That is, the microwave field is formed unevenly in the cooking chamber due to the general cooking apparatus being organized (or arranged) such that the microwaves are radiated from a deflected place in the cooking chamber.

More recently, a stirrer stirring the microwaves or an antenna radiating the microwaves are rotatably installed to be rotated at a part (or location) where the microwaves are radiated, to overcome the aforementioned disadvantage. However, the improvement of uniform heating performance, i.e., using stirrers and antennas has been limited.

Further, the conventional cooking apparatus which uses microwaves has a disadvantage in that there is a limit in which microwaves can be optimized in accordance with the load of the cooking object or the cooking mode, as the microwave is steadily radiated in the cooking chamber. That is, the performance of the conventional cooking apparatus is developed as focusing (or directed to) a middle point satisfying both of the light load and heavy load of the contents to be cooked (or cooking objects). Therefore, the microwave field has to be readjusted, even if there is a small change in the size and shape of the cooking chamber, and it becomes impossible to realize the optimization and maximization of the cooking performance even according to load and cooking mode of the contents.

SUMMARY OF THE INVENTION

An object of the present invention is to provide a cooking apparatus which uses microwaves to improve the uniform heating performance of the microwaves.

Further, another object of the present invention is to provide a cooking apparatus using microwaves and is capable of simply adjusting the heating performance. Additionally, the cooking performance may be improved by providing the microwaves according to the load and the cooking mode of the cooking object (or contents).

To achieve the above-mentioned objects, the present invention provides a cooking apparatus including a microwave supplier (i.e., a microwave supplier) supplying microwaves into the cooking chamber and connected to a side (e.g., an upper side) of the cooking chamber, and a microwave radiator (or radiator) re-radiating the microwave and provided in the cooking chamber.

The microwave radiator may be positioned at a place close to the side of the cooking chamber (e.g., proximate an upper side) connected with the microwave supplier. The microwave radiator may include a conductor having a slot. The microwave radiator may be insert-molded at (or proximate) a non-conductor.

The width of the slot may be not less than approximately one-fourth (¼) of the wavelength of the microwave. The slot may be formed at the microwave radiator having a generally polygonal shape or generally round shape, which may be provided in accordance with the cooking mode or cooking load. Further, the slot may be formed as a plurality of slots at (or proximate) the microwave radiator, and at least one shape may be one of a generally polygonal shape or generally round shape in accordance with the cooking mode or cooking load. The slots may be arranged (or provided) at the microwave radiator in various patterns, which may also be provided in accordance with the cooking mode or the cooking load.

The microwave supplier may include a magnetron which generates the microwaves and is positioned (or provided) at (or proximate) the outer side of the cooking chamber, a microwave guide unit formed (or provided) between the magnetron and the cooking chamber (i.e., a microwave guide) to guide the microwaves, a stirrer bar configured to rotate at a predetermined speed and provided to penetrate a side (e.g., an upper side) of the cooking chamber, and a stirrer coupled with the end part of the stirrer bar arranged (or provided) in the cooking chamber and spaced from the microwave radiator to prevent interference with the microwave radiator.

Further, according to another aspect of the present invention, the present invention provides a cooking apparatus including a microwave supplier which supplies microwaves into the cooking chamber and may be connected to a side of the cooking chamber, and a microwave radiator re-radiating microwaves, the microwave supplier configured to be detachably coupled to an inside of the cooking chamber.

The microwave radiator may be provided at a place close to (or proximate) a side (e.g., an upper side) of the cooking chamber connected with the microwave supplier. The microwave radiator may include a divider which divides the cooking chamber and the cooking space, the microwave radiator may include a conductor having a slot, and an connector configured to be detachably coupled at a side (e.g., an upper side) of the inside of the cooking chamber and formed (provided) at (or on) the divider.

The width of the slot may be not less than approximately one-fourth (¼) of the wavelength of the microwaves. The slot may be formed at the microwave radiator having a generally polygonal shape or a generally round shape, which may be provided in accordance with the cooking mode or cooking load. Further, the slot may be formed (or provided) as a plurality of slots at (or proximate) the microwave radiator and may have at least one of generally polygonal or generally round shapes, which may be provided in accordance with the cooking mode or cooking load. The slots may be arranged (or provided) in various patterns, which may also be provided in accordance with the cooking mode or the cooking load.

The microwave radiator may be provided as a plurality of microwave radiators, which may be provided in accordance with the shape and position of the slots, and at least one of the plurality of microwave radiators may be provided in the cooking chamber in accordance with the cooking mode and the cooking load. The connector may include a protrusion configured to be detachably coupled to a groove formed at the inner surface of the cooking chamber. In this regard, the protrusion may be formed (or provided) at the end part of the divider. A plurality of grooves may be formed at a distance (or spaced) from each other at the inner surface of the cooking chamber, and the microwave radiator may be provided at one of the plurality of grooves in accordance with the cooking mode and the cooking load. Further, the connector may include a magnet coupled (or connected) to=the inner surface of the cooking chamber, the magnet being formed (or divided) at the end part of the divider.

BRIEF DESCRIPTION OF THE DRAWING

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE PREFERRED EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail as for the cooking apparatus using microwave according to the present invention with reference to the accompanying drawings.

Figure 1:
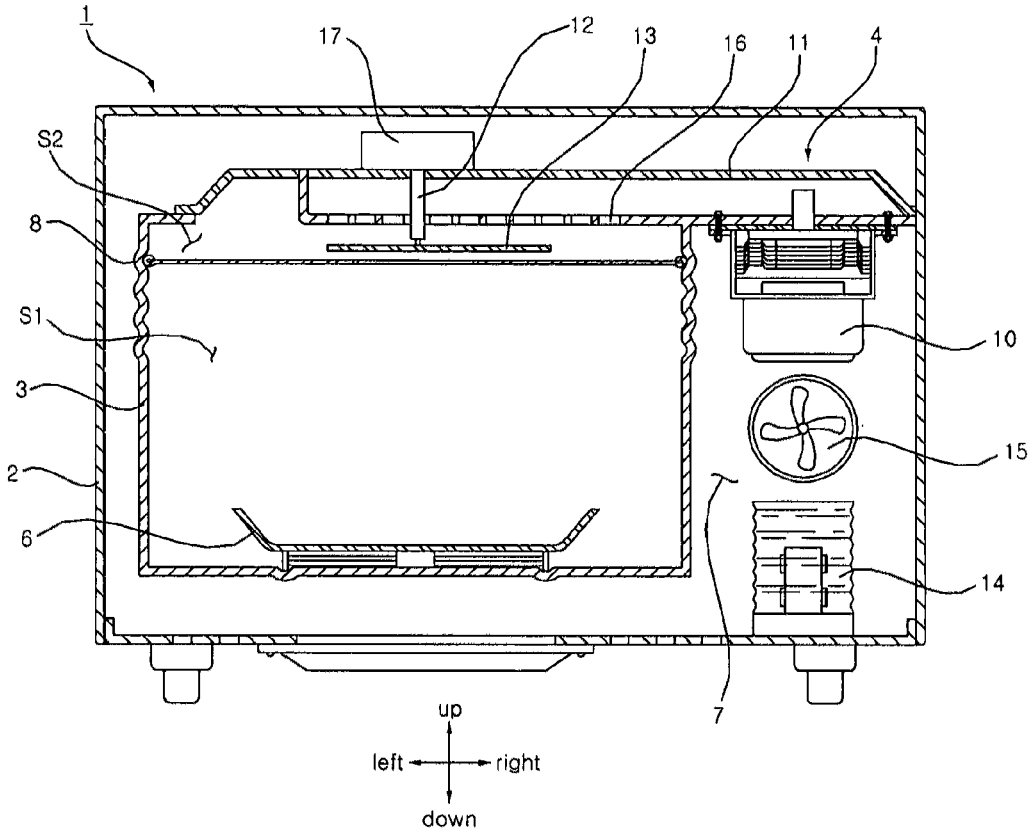
FIG. 1 is a sectional view illustrating the organization of an electronic oven according to a preferred embodiment of the present invention.
Figure 2:
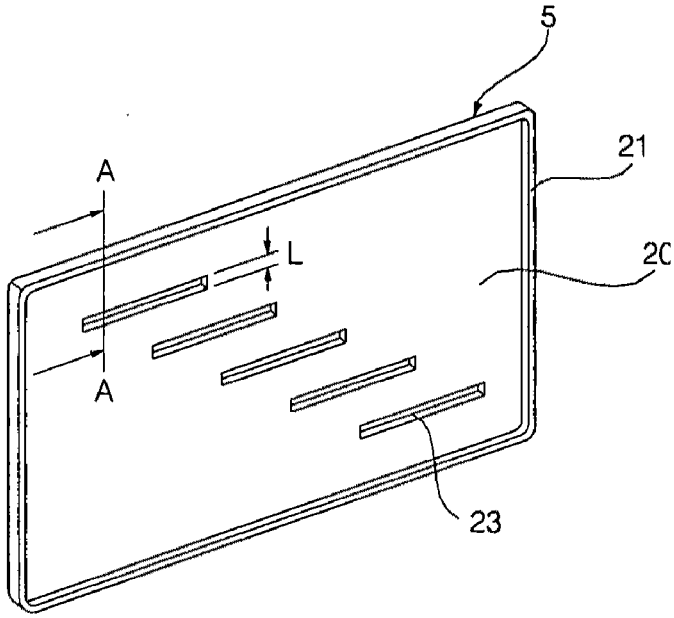
FIG. 2 is a perspective view of the microwave radiator illustrated in FIG. 1.
Figure 3:
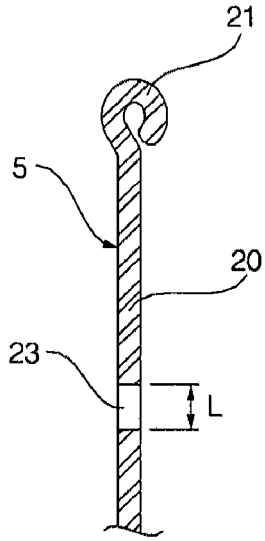
FIG. 3 is a sectional view along the line A-A illustrated in FIG. 2, FIGS. 4 A-H are plane views illustrating other examples of the microwave radiator illustrated in FIG. 2, FIGS. 5 A and B are views illustrating the inner situation of the cooking chamber according to whether the microwave radiator illustrated in FIG. 2 is used or not.
Figure 4:
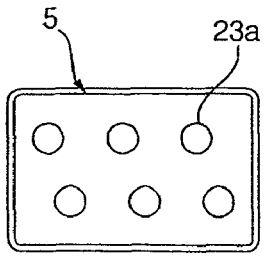
Figure 4:
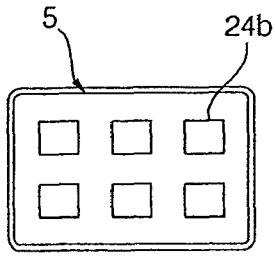
Figure 4:
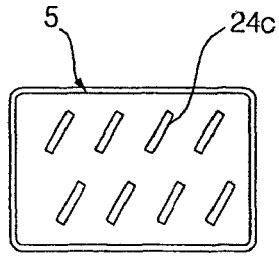
Figure 4:
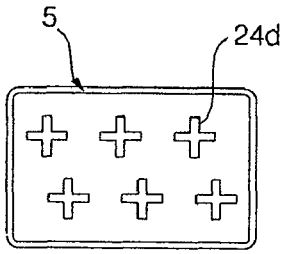
Figure 4:
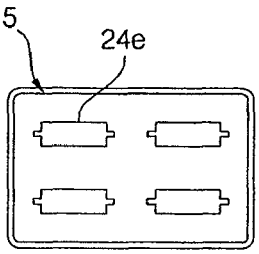
Figure 4:
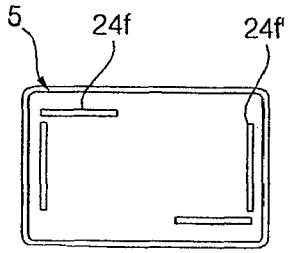
Figure 4:
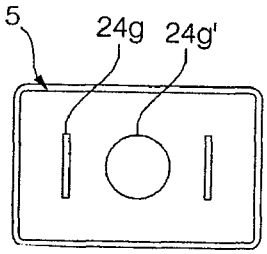
Figure 4:
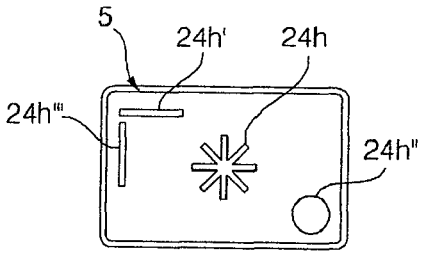

FIG. 1 is a sectional view illustrating the organization of an electronic oven according to a preferred embodiment of the present invention, FIG. 2 is a perspective view of the microwave radiator illustrated in FIG. 1, FIG. 3 is a sectional view along the line A-A illustrated in FIG. 2, FIGS. 4 A-H are plane views illustrating other examples of the microwave radiator illustrated in FIG. 2, and FIG. 5 is a view illustrating the inner situation of the cooking chamber according to whether the microwave radiator illustrated in FIG. 2 is used or not.

Referring to FIG. 1, the cooking apparatus of the present invention which uses microwaves may be an electronic oven 1. The electronic oven 1 may include a casing 2 having a front which is configured to be opened, a cooking chamber 3 provided (or arranged) inside of the casing 2. Further, the cooking chamber may have an entrance at the front surface for receiving/removing contents, a microwave supplier 4 which supplies microwaves into the cooking chamber 3 and may be connected to the upper side of the cooking chamber 3, and a microwave radiator 5 provided in the cooking chamber to partition the upper part of the cooking chamber 3 and the cooking space, the microwave radiator having slots 23 to re-radiate the microwaves.

The cooking chamber 3 is provided in the casing, the microwave supplier and the microwave radiator 5 may have a generally box-shape that includes a front which is configured to be opened. A door (not shown) which opens and shuts the entrance may be connected to a side of the front of the casing 2 to be rotated. A control panel (not shown) may be provided at another side of the front of the casing 2. The control panel may include a display which displays an operating condition of the electronic oven 1 to outside, and an operator configured to select the cooking mode or control the operation of the electronic oven 1.

The cooking chamber 3 may be a generally box-shaped member having a cavity for removing contents in and out of the chamber. In this regard, the cooking chamber 3 may be formed of a conductive material. Additionally, an entrance may be provided (or formed) at the front of the cooking chamber 3, and a tray 6 on which the contents are to be placed may be arranged at the proximate a bottom inside of the chamber (e.g., such that the tray 6 may be rotated).

The microwave supplier 4 may include a magnetron 10 which generates microwaves, and is provided between the cooking chamber 3 and the casing 2, a microwave guide 11 leading (or guiding) the microwaves into the cooking chamber 3, the microwave guide being connected with between the magnetron 10 and the upper part of the cooking chamber 3, and a stirrer bar 12 rotatably provided at an upper side of the cooking chamber 3 to be rotated at one end and the other end may be positioned (or provided) at (or proximate) the microwave guide 11 and the inside of the cooking chamber 3, and a stirrer 13 may be connected to the other end of the stirrer bar 12 and spaced from the microwave supplier 4 to be prevented from the interference with the microwave radiator 5.

The magnetron 10 may be provided at the electric component chamber 7 and formed between the cooking chamber 3 and the casing 2. In this regard, the magnetron 10 may generate microwaves by receiving high-pressured power from the high-pressure transformer 14 which may be installed in the electric component chamber 7. Further, a cooling fan 15 may be installed in the electric component chamber 7 to refrigerate the magnetron 10 and the high-pressure transformer 14.

The microwave guide 11 may be a transmission passage leading the microwave generated by the magnetron 10 to an upper side (or a top) of the cooking chamber 3. A plurality of radiation holes 16 which radiate the microwaves into the cooking chamber 3 may be formed at the top of the cooking chamber 3 and connected proximate the microwave guide 11.

The stirrer bar 12 may be rotated at a regular speed by the operating device 17. In this regard, the stirrer bar 12 may penetrate the upper side of the cooking chamber 3 and may be connected proximate the microwave guide 11. The operation device 17 may include a motor connecting an end of the stirrer bar 12 with a rotation shaft. The other end of the stirrer bar 12 may be connected to the stirrer 13 and provided (or arranged) in the cooking chamber 3.

The stirrer 13 may have a generally fan-shape which may be rotated with the stirrer bar 12. In this regard, the center (or middle) part of the stirrer 13 may be coupled with the other end of the stirrer bar 12. The stirrer 13 may include a conductor. Therefore, the microwaves may be uniformly transmitted into the cooking chamber 3, as the stirrer stirs the microwaves radiated through the plurality of radiation holes 16, when the stirrer 13 is rotated at the lower side of the radiation holes 16 during the operation of the magnetron 10.

Referring to FIGS. 2 to 3, the microwave radiator 5 may include a divider 20 provided in the cooking chamber 3 and having slots 23, and a connector 21 formed (or provided) at (or on) the divider 20 to detachably couple the divider 20 at (or proximate) the inner side of the cooking chamber 3.

The divider 20 may be provided as a generally board-shape (or flat-shape) member provided adjacent (or proximate) an upper side of the cooking chamber 3, and may be spaced from a lower side of the stirrer by a predetermined interval to be prevented from interfering with the stirrer 13 or the stirrer bar 12. Therefore, the inner space of the cooking chamber may be divided into upper and lower parts by the divider 20, and a radiation space S1 that the microwave is radiated (e.g., initially) may be formed at the upper side of the divider 20, and a cooking space S2 for cooking the contents may be formed at the lower side of the divider 20. The divider 20 may include a conductor.

The slots are formed with a width L of more than approximately ¼ the size of the wavelengths of the microwaves. That is because, when the width L of the slot 23 is shorter than approximately ¼ of the wavelength of the microwaves, it is virtually impossible for the microwaves to pass through the slot 23. Therefore, the radiation hole 16 may be formed with the width longer than approximately ¼ the wave length of the microwaves. The slot 23 may be formed having a generally polygonal shape at (or proximate) the divider 20, and a plurality of slots may be regularly provided adjacent in the diagonal direction at the divider 20. Therefore, the microwave stirred by the stirrer 13 may be re-radiated uniformly into the cooking space S2 through the slot(s) of the divider 20.

On one hand, other examples of the slots 23 are illustrated in FIGS. 4 A-H That is, the slots 23*a*, 23*b*, 23*c*, 23*d*, 23*e* are formed in one form having generally polygonal or generally round shapes as shown at FIGS. 4A to E, and a plurality of the slots 23*a*, 23*b*, 23*c*, 23*d*, 23*e* may be arranged (or provided) in a regular pattern at (or proximate) the divider 20. Further, each of the slots 23*g*, 23*g*', 23*f*, 23*f*', 23*h*, 23*h*', 23*h*" and 23*h*'" may be formed as shown at FIGS. 4F to H in a form different with each other, and a pluralities of slots 23*g*, 23*g*', 23*f*, 23*f*', 23*h*, 23*h*', 23*h*" and 23*h*'" may be arranged at the divider 20 in irregular patterns. If the shapes and positions of the slots 23 are changed as above, the cooking performance of the electronic oven 1 may also be changed, as the fields of the microwave re-radiated into the cooking space S2 of the cooking chamber 3 through the slots 23 may be changed (or altered). Therefore, the electronic oven 1 has a plurality of microwave radiators 5 at which the shapes and positions of the slots 23 are formed to be different from each other in order to optimize and maximize the cooking performance, which may be provided according to the loads of the cooking objects (or contents) and cooking modes.

The connector 21 may include a protrusion 21 configured to be detachably coupled to a groove 8 formed at the inner side of the cooking chamber 3 to, the connector 22 may be formed (or provided) at the end part of the divider 20. The connector 21 may include a conductor provided as the divider 20.

The protrusion 21 may be formed in one organization as the end part of the divisional unit 20 having a generally curled-shape as illustrated in FIG. 3. However, the protrusion 21 may also be formed as a separate member coupled at the end part of the divider 20. However, it should be appreciated that the end part of the divider 20 may be formed or provided having any structure suitable from coupling the divider 20 to an inside of the cooking chamber 3.

The groove 8 may permit insertion of the protrusion 21 of the microwave radiator 5 in the back and forward direction such that the groove(s) 8 face each other at the left side and right side of the cooking chamber. The groove 8 may be formed (or provided) as a plurality of adjacent grooves in upward and downward directions at the left side and right sides of the cooking chamber 3. For example, the plurality of equipment grooves 8 may be formed at a place close to (i.e., proximate) an upper side of the cooking chamber 3 so that the microwaves are easily re-radiated through the slots 23. Further, the plurality of equipment grooves 8 may be positioned proximate to the upper side of the cooking chamber 3 and spaced by a predetermined distance from the stirrer to prevent interference between the stirrer 13 and the divider 20. However, the protrusion 21 may be inserted at the middle part in the back and forward direction, when the groove 8 is organized as a pair of brackets attached adjacent in the up and downward at the left and right sides of the cooking chamber 3.

Therefore, the microwave radiator 5 controls the adjacent intervals between the top of the cooking chamber 3 and the divider 20 by selectively providing the microwave radiator 5 at one of the plurality of grooves 8. The cooking performance of the electronic oven 1 may be changed as the microwave field passes through the slots 23 of the microwave radiator 5 and when the distance (or spacing) between the top of the cooking chamber 3 and the divisional unit 20 is changed.

Reference will now be made in detail as for the functioning and the operation effects of the electronic oven 1 according to a preferred embodiment of the present invention configured as above.

Firstly, a microwave radiator 5 suitable for the load of the contents (or cooking object) or the cooking mode may be selected. In other words, by selecting a microwave radiator 5 having shapes or arrangements of the slots 23 the performance of the oven 1 may be optimized according to the load of the cooking object or the cooking mode. Further, the door of the electronic oven 1 may be opened and the microwave radiator 5 may be provided in the cooking chamber 3. At this time, the protrusion 21 formed at the end part of the microwave radiator 5 may be slidably inserted in a horizontally and backward direction such that the protrusion is fitted into the groove 8 formed (or provided) at the left and right sides of the cooking chamber 3.

After installing the microwave radiator 5, contents (or a cooking object) may be placed on the tray 6 in the cooking chamber 3, and the opening of the cooking chamber 3 may be shut by closing the door. Further, the cooking mode for the contents may be set through the control panel thereby operating the electronic oven 1.

The pressure of the high-pressure transformer 14 of the electronic oven may be raised by receiving a high pressure. More particularly, microwaves may be generated due to the high-pressured power received by the magnetron 10. The microwaves may be transmitted to an upper side of the cooking chamber through the microwave guide 11, and may be first radiated into the radiator S1 of the cooking chamber 3 through the radiation holes 16 formed at the joint parts of the upper side of the cooking chamber 3 and the microwave guide 11.

Here, the microwaves radiated into the radiator S1 may spread more uniformly in the cooking chamber 3 when stirred by the stirrer 13 rotated with the stirrer bar 12. Further, the microwaves stirred by the stirrer 13 may then be radiated into the cooking space S2 of the cooking chamber 3 through (or via) the slots 23 of the microwave radiator 5. Therefore, the contents placed on the tray 6 may be cooked according to the cooking mode by the subsequently radiated microwaves.

Figure 5A:
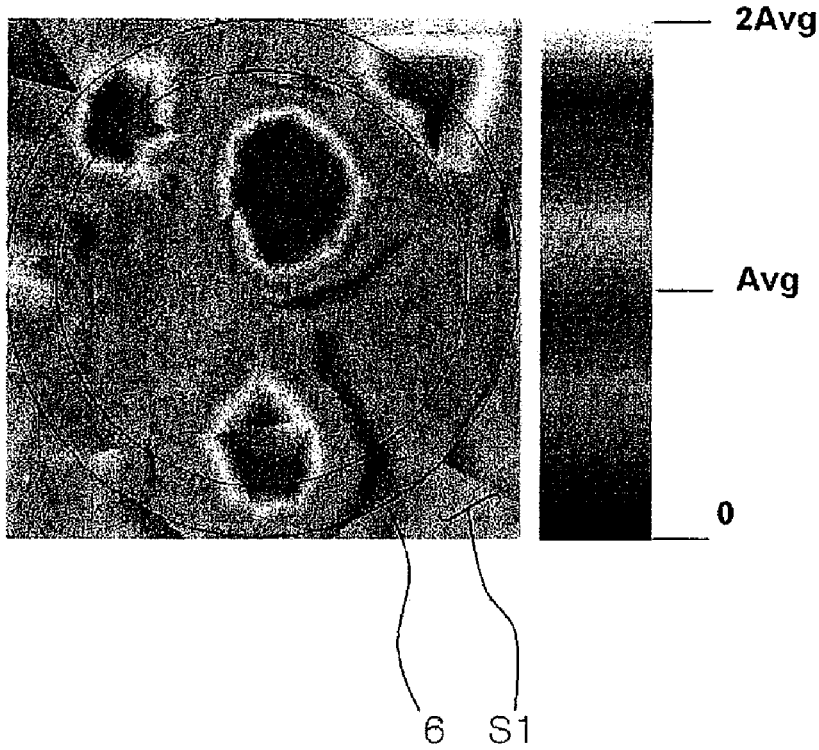
Figure 5B:
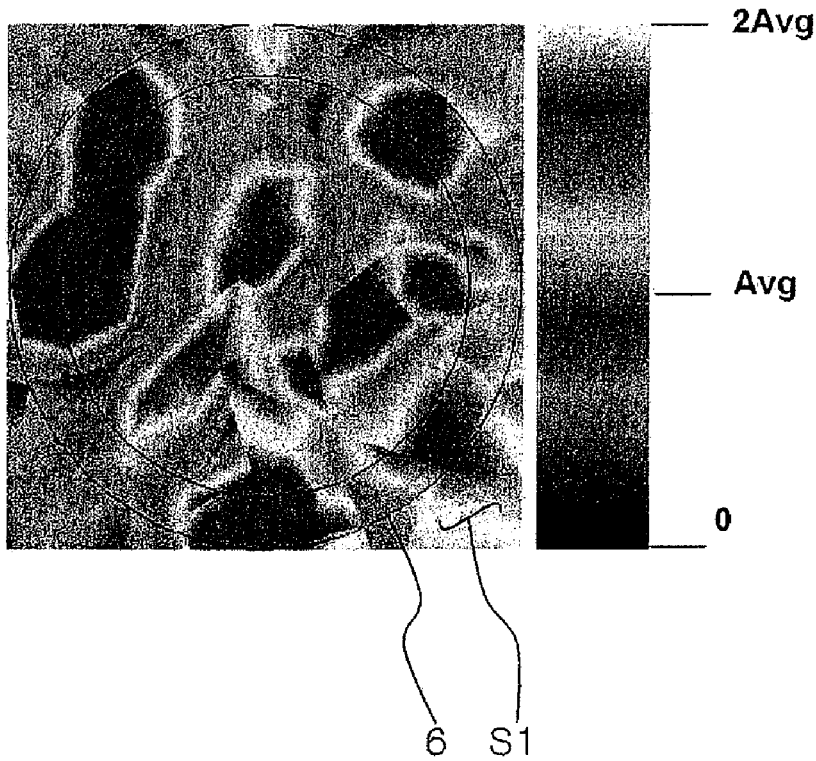

FIG. 5A is an experiment amount showing the microwave field of the tray 6 gauged in the condition when the microwave radiator 5 is not provided inside of the cooking chamber 3, and FIG. 5B is an experiment amount showing the microwave field of the tray 6 gauged in the condition when the microwave radiator 5 is provided in the cooking chamber 3. Here, the contents on the tray 6 may be a lump of beef of 1 pound, the cooking mode of the electronic oven 1 may be in a thawing mode, and the microwave radiator 5 may be provided at a place adjacent 30 cm in a downward direction from the stirrer 13, and having slots 23 illustrated in FIG. 2.

When comparing the microwave fields illustrated in FIGS. 5A and B, the microwave field in FIG. 5B is uniformly formed stronger at the tray 6 side than microwave field shown in FIG. 5A. Therefore, the thawing time may be shortened and the thawing quality may be improved.

When the cooking of the cooking object is completed, a signal signifying completion of the cooking may be displayed through the display of the control panel. Then, the cooked contents (or cooking object) may be removed from the inside of the cooking chamber 3, and the inside of the cooking chamber 3 may be cleaned. Here, the cleaning condition of the electronic oven 1 may be improved, as it is easily cleaned after removing the microwave radiator 5 from the inside of the cooking chamber 3.

Further, the microwave may be radiated in a more optimized condition based on either one of the load of the contents (or cooking objects) and the cooking modes. Therefore, the uniform heating performance of the electronic oven 1 may be improved when the microwaves are radiated more uniformly toward the tray 6. Further, the cooking performance of the electronic oven 1 may be improved, as the microwave are radiated with the most proper strength for the load of the cooking objects and the cooking mode.

Additionally, a plurality of microwave radiator s5 having different shapes and arrangements of slots 23 may be supplied (or provided inside) to the electronic oven 1 according to the load of the contents and cooking mode. Therefore, one of the pluralities of microwave radiators 5 may be selected (or provided) according to the load of the cooking objects and cooking mode.

Furthermore, the adjacent distances of the microwave radiators 5 to the stirrer 13 may be changed as the microwave radiators are selectively fitted into the plurality of the grooves formed at the cooking chamber 3. Thus, the heating performance of the contents may also change. In this regard, the microwave radiator 5 may change the re-radiation performance of the microwaves when the adjacent distances between the stirrer 13 and the microwave radiator 5 are changed. Therefore, the cooking performance of the electronic oven 1 may be improved as the microwave radiator 5 is selectively provided at the plurality of the equipment grooves 8 in accordance with the load of the contents (or cooking objects) and the cooking mode.

The position of the microwave radiator 5, shapes of the slots 23, and the arrangements of the slots 23 will each affect the uniform heating performance and the cooking performance of the electronic oven 1. Therefore, the alternative for providing the electronic oven 1 may be improved. Additionally, cooking modes of the electronic oven 1 may be provided in a variety of arrangements and cooking quality may be improved, as performance elements (i.e., elements which affect heating performance) are provided to the electronic oven 1 are added.

Figure 6:
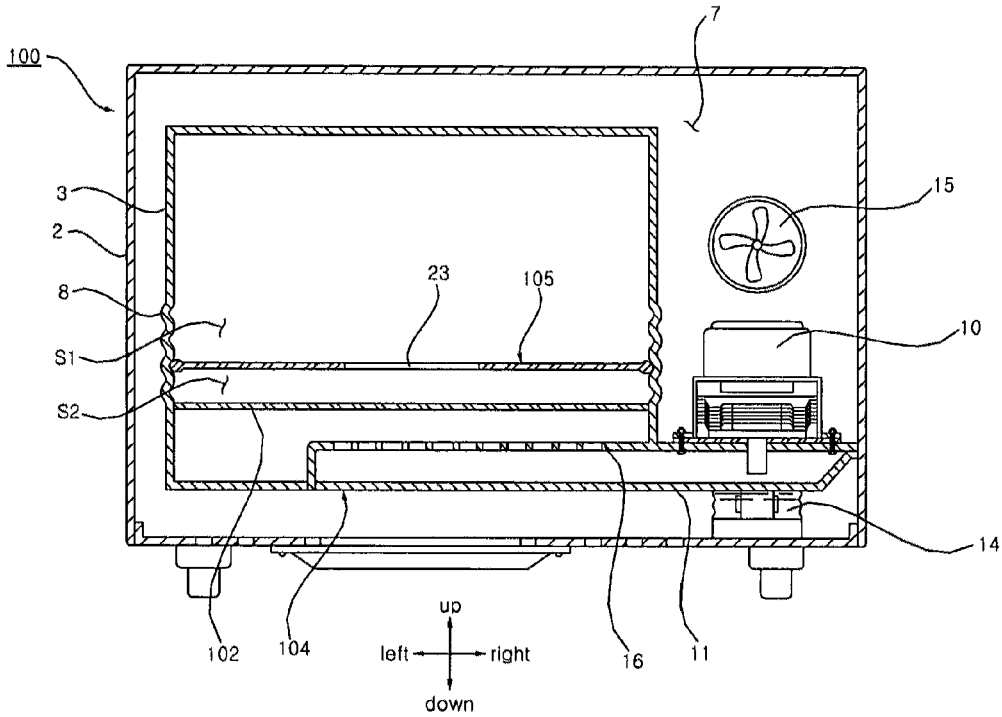
FIG. 6 is a sectional view illustrating the organization of an electronic oven according to another preferred embodiment of the present invention.

FIG. 6 is a sectional view illustrating the organization of an electronic oven according to another preferred embodiment of the present invention. The same reference numerals are given to similar components as described above.

The electronic oven 100 illustrated in FIG. 6 illustrates the microwave guide 11 of the microwave supplier 104 being connected between the bottom of the cooking chamber 3 and the magnetron 10. In this regard, the microwave radiator 105 may be provided proximate the bottom of the cooking chamber 3, and the stirrer 13 and the stirrer bar 12, as illustrated in FIG. 1, may be omitted.

A plurality of microwave radiation holes 16 which radiate microwaves into the cooking chamber 3 may be formed at the juncture where the bottom of the cooking chamber 3 and the microwave guide 11 are connected. A diaphragm 102 may be arranged at a place adjacent toward the upper side from the radiation holes 16 with a predetermined distance in the cooking chamber 3. The diaphragm 102 may be a member in the form a form of a plane board on which the tray 6 is set on a surface thereof, and may include a non-conductive substance which permits the smooth passage of the microwaves into the cooking chamber 3.

The microwave radiator 105 may be provided at the plurality of equipment grooves 8 formed at the upper side of the diaphragm 102. Here, when the microwave radiator is equipped in the cooking chamber 3, the tray 6 or the contents (or cooking object) is arranged on the top of the microwave radiator 105. Therefore, the microwave passed through the diaphragm 102 may be re-radiated uniformly into the cooking chamber 3 by slots 23 of the microwave radiator 105, and the uniform heating performance and cooking performance of the electronic oven 100 may improved as the contents (or cooking objects) are cooked by microwave re-radiated.

Further, the microwave radiator 105 may be used as a tray (e.g., for fishes or meats) in accordance with its necessity when it is formed (or provided) as a grill having a plurality of slots 23. Further, the uniform heating performance of the electronic oven 100 may be improved by the microwave radiator 105.

Figure 7:
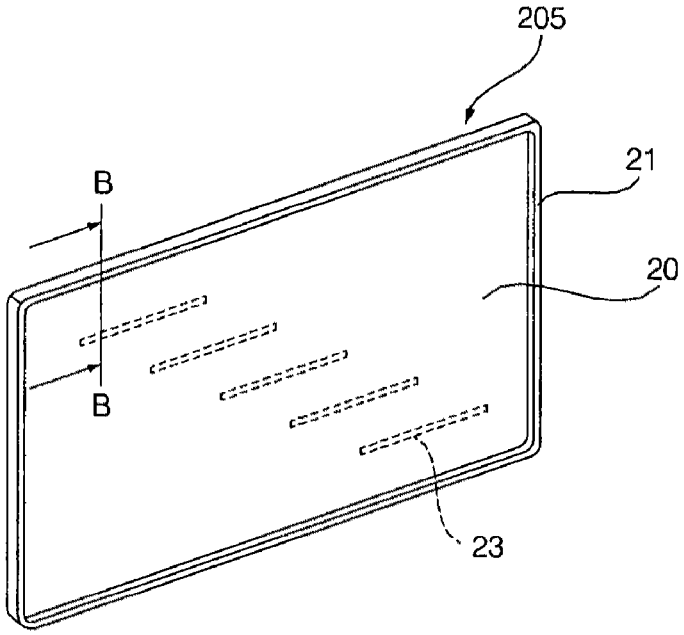
FIG. 7 is a perspective view of the microwave radiator of an electronic oven according to another preferred embodiment of the present invention.
Figure 8:
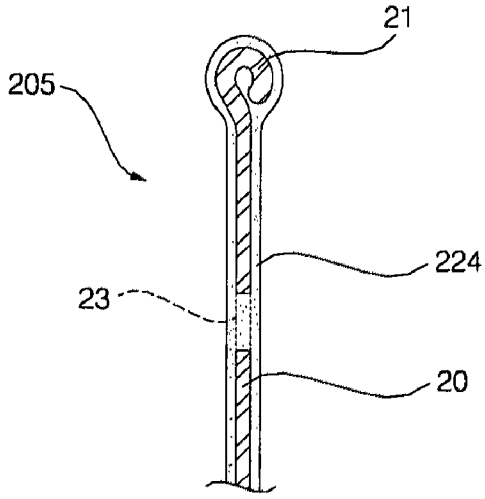
FIG. 8 is a sectional view along the line B-B illustrated in FIG. 7.

FIG. 7 is a perspective view of the microwave radiator of an electronic oven according to another preferred embodiment of the present invention, and FIG. 8 is a sectional view along the line B-B illustrated in FIG. 7. The same referential numerals are given to the organizations having same or similar components as discussed above.

In FIGS. 7 and 8 the microwave radiator 5 is provided 205 by insertion molding a non-conductive substance 224 which does not affect the flow of microwaves.

The microwave radiator 205 includes a divider 20 and connector 21, and a plurality of slots 23 which may be formed in various shapes at (or proximate) the divider 20.

When the microwave radiator 205 formed by insertion molding a non-conductive substance 224, the divider 20 and the connector 21 provided inside of (or embedded in) the non-conductor 224, and the slots may also be covered by the non-conductor 224.

Therefore, when the coating layer of non-conductive substance 224 is formed at the outer side of the microwave radiator 205, the appearances of the microwave radiator 205 and cooking chamber 3 are improved, and the danger of injury to a user caused by the slots 23 is reduced. Further, because the foreign elements generated during cooking using the slots 23 do not enter the slots, blockage of the slots by foreign elements may be prevented, and the cleaning condition of the electronic oven and microwave radiator 205 may be improved.

Figure 9:
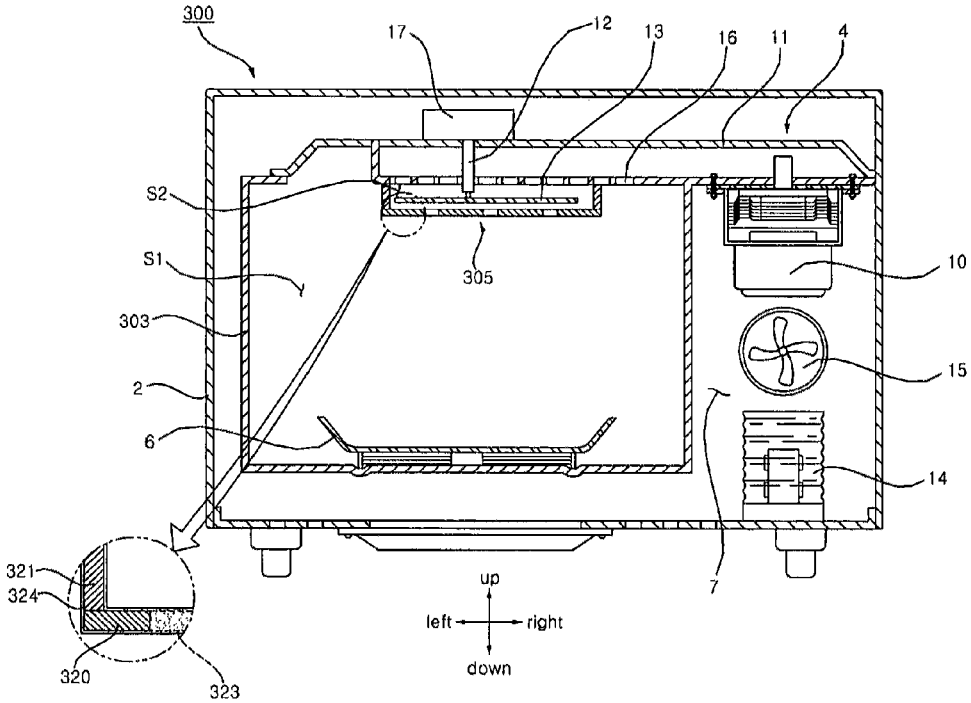
FIG. 9 is a sectional view illustrating the organization of an electronic oven according to another preferred embodiment of the present invention.
Figure 10:
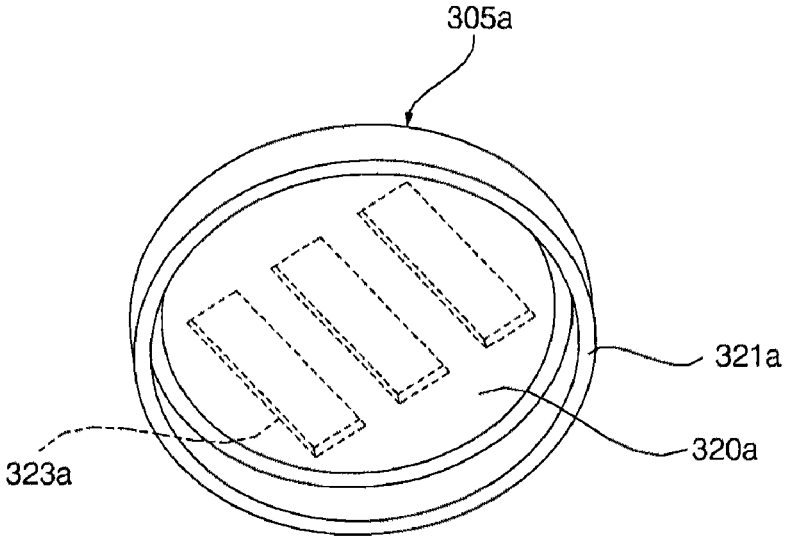
FIG. 10 is a perspective view of the microwave radiator illustrated in FIG. 9.
Figure 11:
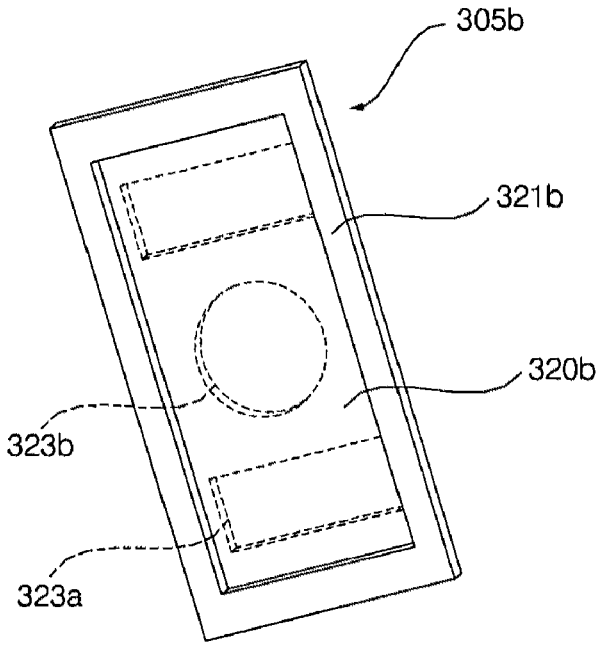
FIG. 11 is a perspective view illustrating other examples of the microwave radiator illustrated in FIG. 9.

FIG. 9 is a sectional view illustrating the organization of an electronic oven according to another preferred embodiment of the present invention, FIG. 10 is a perspective view of the microwave radiator illustrated in FIG. 9, and FIG. 11 is a perspective view illustrating other examples of the microwave radiator illustrated in FIG. 9.

The electronic oven 300, as illustrated in FIG. 9, includes a microwave radiator 305 having a divider 320 and a protrusion 321. Further, the connector 321 may include a magnet 321 detachably coupled at the inner side of the cooking chamber 303 and configured to be attached and removed at the end part of the divider 320.

The divider 320 may have a generally board-shaped member provided at the lower side of the stirrer 13 with a predetermined interval. The divider 320 may include a conductor. The divider 320 may be formed having various shapes and to have a width that is larger than the operation scope of the stirrer 13 (i.e., the horizontal width which the stirrer covers during rotation). A plurality of slots 323 may be formed (or provided) having at least one of a generally polygonal and round shape, and may be arranged at the divider 320 in various arrangements.

The connector 321 may include a magnet 321 formed with a predetermined height at the end part of the divider 320 to connect (or couple) the divider 320 at (or proximate) the inner side of the cooking chamber 303 to be attached and removed. Here, the cooking chamber 303 may be formed of a steel material (or any suitable material having a texture (or characteristics) similar to steel). Additionally, the magnet 321 may be attached proximate an upper side of the cooking chamber 303 and provided (or formed) along a circumference of an end of the divider 320. Therefore, the groove 8 formed in the cooking chamber in FIG. 1 may be omitted. In this regard, the microwave radiator 305 may be simply attached and removed at the inner side of the cooking chamber 303 by the magnet 321.

Further, the microwave radiator 305 may be insertion molded from a non-conductive substance 324. Therefore, the divider 320 and magnet 321 may be arranged in the non-conductive substance 324, and the slots 323 may also be covered by the non-conductor 324.

The various examples of the microwave radiator 305 are illustrated in FIGS. 10 and 11. Referring to FIG. 10, the divisional unit 320*a* may be formed as a generally round board at the microwave radiator 305*a*, and pluralities of slots 323*a* may be formed having a rectangular shape and adjacent to each other. The round-shaped magnets 321*a* may be formed along the circumference of the end part of the divider 320*a* with a predetermined height. Referring to FIG. 11, the divider 320*b* may be formed as a generally square board at the microwave radiator 305*b*, and a plurality of slots 323*a* and 323*b* of rectangular shape and round shape may be formed as adjacent to each other at the divider 320*b*.

The square-shaped magnets 321*b* may be formed having a predetermined height along the end part of the divider 320*b*. Also, it is possible for the slots 323 to be formed at the divider 320 with the shapes and arrangements illustrated in FIGS. 2 and 4A-H.

The cooking apparatus using microwave according to the present invention is described with reference to the accompanying drawings, however, the present invention is not limited to the above-mentioned embodiments and drawings, and it possible to utilize variety of shapes, arrangements, and forms without departing from the spirit or scope of the present invention.

That is, the present invention may be applied not only to the electronic ovens, but also to all cooking apparatus cooking foods which use microwaves (e.g., electronic ovens with hoods, other types of ovens and etc). Further, when the microwave supplier is connected to a side of the cooking chamber, the microwave radiator may be provided in the cooking chamber in the upper and lower directions. Further, the microwave supplier can be fixed in the cooking chamber.

More particularly, the cooking apparatus using microwaves according to the present invention has an advantage in that the uniform heating performance may be improved as the microwaves radiated from the microwave supplier are re-radiated by a microwave radiator provided inside of the cooking apparatus.

Further, the cooking apparatus using microwaves according to the present invention has an advantage in that the cooking performance may be optimized and maximized according to the cooking loads and cooking modes by providing (or selecting) a suitable microwave radiator.

Furthermore, the cooking apparatus using microwave according to the present invention has an advantage in that the organization of the cooking apparatus may be improved, as the heating performance by microwave is controlled in accordance with the slots of the microwave radiator or equipment position.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cooking apparatus which uses microwaves, the cooking apparatus comprising:

a microwave supplier which supplies microwaves into a cooking chamber;

a microwave radiator provided inside of the cooking chamber to re-radiate the microwaves; and a plurality of grooves spaced from each other in the cooking chamber, wherein the microwave radiator is detachably coupled to at least one of the grooves.

2. The cooking apparatus according to claim 1, wherein the microwave radiator is provided proximate an upper side of the cooking chamber.

3. The cooking apparatus according to claim 1, wherein the microwave radiator comprises a conductor having at least one slot.

4. The cooking apparatus according to claim 3, wherein the microwave radiator is formed of a non-conductive substance by insertion molding.

5. The cooking apparatus according to claim 3, wherein a width of the at least one slot is not less than approximately one-fourth (¼) of a wavelength of the microwave.

6. The cooking apparatus according to claim 3, wherein the at least one slot is formed having either one of a generally polygonal or generally round shape.

7. The cooking apparatus according to claim 6, wherein the shape of the slot is provided in accordance with either one of a cooking mode or cooking load.

8. The cooking apparatus according to claim 3, wherein the at least one slot is formed as a plurality of slots having either one of a polygonal or round shape.

9. The cooking apparatus according to claim 8, wherein the slots are provided having various patterns.

10. The cooking apparatus according to claim 9, wherein the various patterns are provided in accordance with either one of a cooking mode or cooking load.

11. The cooking apparatus according to claim 8, wherein the plurality of slots are provided in accordance with either one of a cooking mode or cooking load.

12. The cooking apparatus according to claim 1, wherein the microwave supplier comprises:

a magnetron, which generates microwaves, provided at an outer side of the cooking chamber;

a microwave guide, which guides microwaves, formed between the magnetron and the cooking chamber;

a stirrer bar provided proximate an upper side of and penetrating the cooking chamber, the stirrer bar being configured to rotate at a predetermined speed; and a stirrer provided inside of the cooking chamber and coupled with an end part of the stirrer bar, wherein the stirrer bar is spaced from the microwave radiator.

13. A cooking apparatus comprising:

a microwave supplier configured to supply microwaves into the cooking chamber; and a microwave radiator, which re-radiates the microwaves, detachably provided inside of the cooking chamber, wherein the microwave radiator comprises:

a divider which is configured to divide the cooking chamber;

a conductor having at least one slot; and a connector which is configured to detachably couple the microwave radiator to an inside of the cooking chamber, wherein the connector is provided at the divider.

14. The cooking apparatus according to claim 13, wherein the microwave radiator is provided proximate an upper side of the cooking chamber.

15. The cooking apparatus according to claim 13, wherein a width of the at least one slot is not less than approximately one-fourth (¼) of a wavelength of the microwaves.

16. The cooking apparatus according to claim 13, wherein the at least one slot is formed having either one of a generally polygonal or generally round shape.

17. The cooking apparatus according to claim 16, wherein the shape of the slot is provided in accordance with either one of a cooking mode or cooking load.

18. The cooking apparatus according to claim 13, wherein the at least one slot is formed as a plurality of slots having either one of a generally polygonal or generally round shape.

19. The cooking apparatus using microwave according to claim 18, wherein the plurality of slots are provided having various patterns.

20. The cooking apparatus according to claim 19, wherein the plurality of slots are provided in accordance with either one of a cooking mode or cooking load.

21. The cooking apparatus according to claim 18, wherein the plurality of slots are provided in accordance with either one of a cooking mode or cooking load.

22. The cooking apparatus according to claim 13, wherein the microwave radiator is a plurality of microwave radiators, and wherein at least one of the microwave radiators is detachably provided inside of the cooking chamber.

23. The cooking apparatus according to claim 13, wherein the connector includes a protrusion configured to be detachably coupled to a groove provided inside of the cooking chamber.

24. The cooking apparatus according to claim 23, wherein a plurality of grooves are provided spaced from each other in the cooking chamber, and wherein the microwave radiator is detachably coupled to at least one of the grooves.

25. The cooking apparatus according to claim 24, wherein the microwave radiator is provided at one of the grooves in accordance with either one of a cooking mode or cooking load.

26. The cooking apparatus according to claim 13, wherein the connector includes magnets connected to an inside of the cooking chamber, the magnets configured to be detachably coupled to the divider.

* * * * *